United States Patent [19]

Holtsch

[11] 3,943,647

[45] Mar. 16, 1976

[54] DEVICE FOR RECORDING ON AND STORAGE OF INFORMATION CARDS

[76] Inventor: Peter. E. Holtsch, 6204 Taunusstein-Wingbach, Germany

[22] Filed: Feb. 25, 1974

[21] Appl. No.: 445,720

[30] Foreign Application Priority Data

Feb. 24, 1973 Germany ..... 2309412

[52] U.S. Cl. ..... 40/73.4

[51] Int. Cl.[2] ..... G09F 11/06

[58] Field of Search ..... 40/102, 72, 73.4, 358; 211/69.1, 69.6, 69.7

[56] References Cited

UNITED STATES PATENTS

| | | | |
|---|---|---|---|
| 1,092,156 | 4/1914 | Mathis | 40/124 X |
| 1,549,675 | 8/1925 | Marcuson | 211/69.1 |
| 1,813,442 | 7/1931 | Dobrowsky | 40/73.4 |
| 2,130,428 | 9/1938 | Katz | 40/35 |
| 2,761,750 | 9/1956 | Neilsen | 40/72 X |
| 3,261,649 | 7/1966 | Erickson | 40/72 |
| 3,279,108 | 10/1966 | Cappellari | 40/35 |
| 3,281,975 | 11/1966 | Simone | 40/358 |

*Primary Examiner*—Louis G. Mancene
*Assistant Examiner*—Wenceslao J. Contreras
*Attorney, Agent, or Firm*—Neil F. Markva

[57] ABSTRACT

A device is used for storing and recording on information cards composed of flexible material. Each card is pivotally mounted along one edge thereof within a housing having an observation opening for viewing the information cards. A holding support mechanism is disposed along the lower edge of the observation opening. The holding support mechanism includes an element that is pivotally mounted to swivel in one direction out of the path of the cards as they move downwardly past the lower edge of the observation opening. The holding mechanism is effective to hold the cards back when the cards are moved in the upward direction. The cards are elastically held up to a predetermined tension sufficient for the cards to jump to an upstanding position once it is released by the holding mechanism. The housing of the device may include a storage area for paper and writing styluses.

11 Claims, 5 Drawing Figures

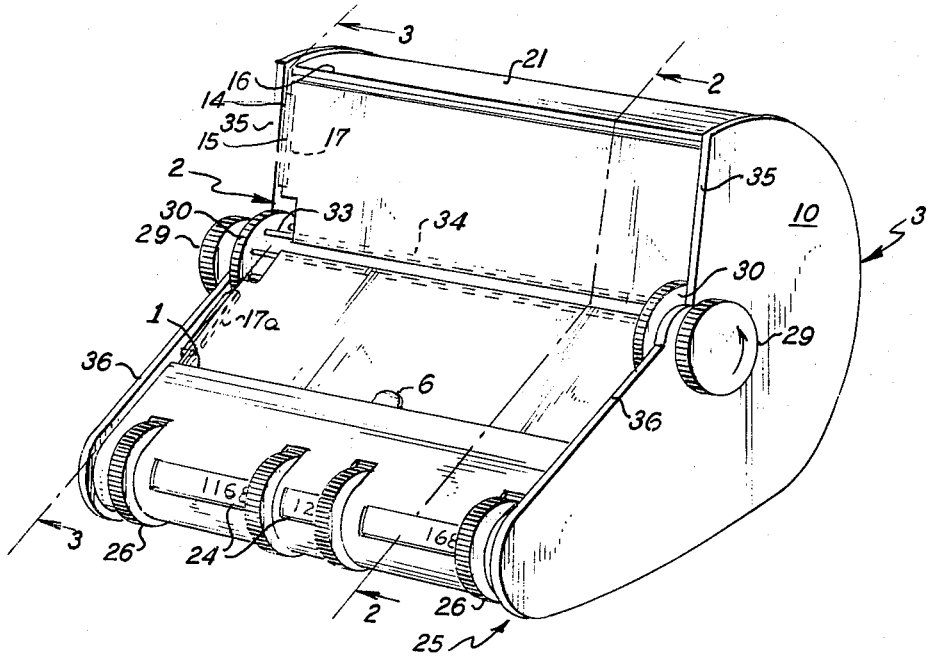
FIG. 1
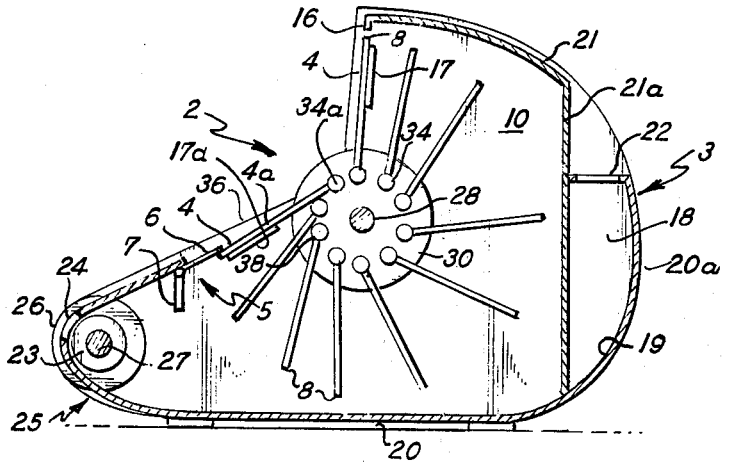
FIG. 2
FIG. 3

DEVICE FOR RECORDING ON AND STORAGE OF INFORMATION CARDS

BACKGROUND OF THE INVENTION

This invention relates to a device for recording on and the storage of information cards made of flexible material. The information cards are articulated or pivotally mounted within a housing and on a rotatably disposed mechanism. An observation opening in the housing includes an upper portion for reading one side of the information card and a lower portion for reading the other side of the information card. Such a device for storing information cards is well known.

Such known record storage devices include a housing having a flange which is angular in a downward direction along the upper edge of the observation opening. Upon turning of the roller, the flexible cards are held back elastically behind the free end of the flange. By turning the roller mechanism further, the flexible card is bent, slides through below the upper edge of the observation opening and pivotally falls downwards to the other or lower portion of the observation opening. In this manner, the front side of the succeeding card and the reverse side of the pivoted or tilted care are unobstructed for recording thereon and reading information therefrom.

This known recorder has the disadvantage that the roller mechanism must always be turned in one direction for the reading of and recording on the register or information cards. That is, the roller mechanism which carries the cards pivotally mounted thereon must be turned in such a way that the cards will tip from above in the upper portion of the observation opening to a position in the lower portion of the observation opening. If the roller mechanism which carries the pivotally mounted cards is turned in a reverse direction, it is not possible to read or record on the cards because the cards do not tip to the other direction.

PURPOSE OF THE INVENTION

The primary object of this invention is to provide a device having a roller mechanism carrying the pivotally mounted information cards so that they may be read or recorded on with respect to both sides when the roller mechanism is turned in either a counter-clockwise or a clockwise direction.

SUMMARY OF THE INVENTION

This objective and other advantages are obtained through the invention as described herein. The device includes a housing and a holding support mechanism disposed at the lower edge of the observation opening in the housing. The holding mechanism includes a means which pivotally moves in and out of the path of the information cards as they are rotated from the upper portion of the observation opening to the lower portion of the observation opening.

The holding mechanism normally includes a portion which projects into the observation opening and in the path of the downwardly moving information card. Once the card has passed beyond the lower edge of the observation opening, the projecting portion of the holding mechanism stands in the way of the card being rotated back to the upper portion of the observation opening. That is, the holding mechanism retards the movement of the flexible cards elastically in one direction up to a predetermined amount of tension which is sufficient to make the card resiliently jump to the upper portion of the observation opening and pivot about its pivot point so that the other side of the card is observable.

In a specific embodiment of the invention, a rotating mechanism includes a shaft about which the flexible cards are pivotally mounted in an annular disposition. The holding mechanism includes an element that will hold back the flexible information card until the pretension achieved by continued turning of the shaft is sufficient to make the card resiliently jump up to and behind the upper tipping point. The upper tipping point is the point at which the card pivots so that the other side of the information card is now observable in the upper portion of the observation opening.

It is not necessary to turn the information card rotating mechanism through a complete 360° if it is desired to view the other side of the card which is in the lower portion of the observation opening. By simply turning the rotating mechanism in a reverse direction through a very small dimension, the desired card can be turned upwardly thorugh the interaction of the flexibility of the card and the holding element disposed at the lower edge of the observation opening.

BRIEF DESCRIPTION OF DRAWINGS

Other objects of this invention will appear in the following description and appended claims, reference being made to the accompanying drawings forming a part of the specification wherein like reference characters designate corresponding parts in the several views.

FIG. 1 is a perspective view of an apparatus made in accordance with this invention, FIG. 2 is a cross-sectional view taken along line A—A of FIG. 1;

FIG. 3 is a cross-sectional view taken along line B—B of FIG. 1;

DESCRIPTION OF SPECIFIC EMBODIMENTS

Figure 4:
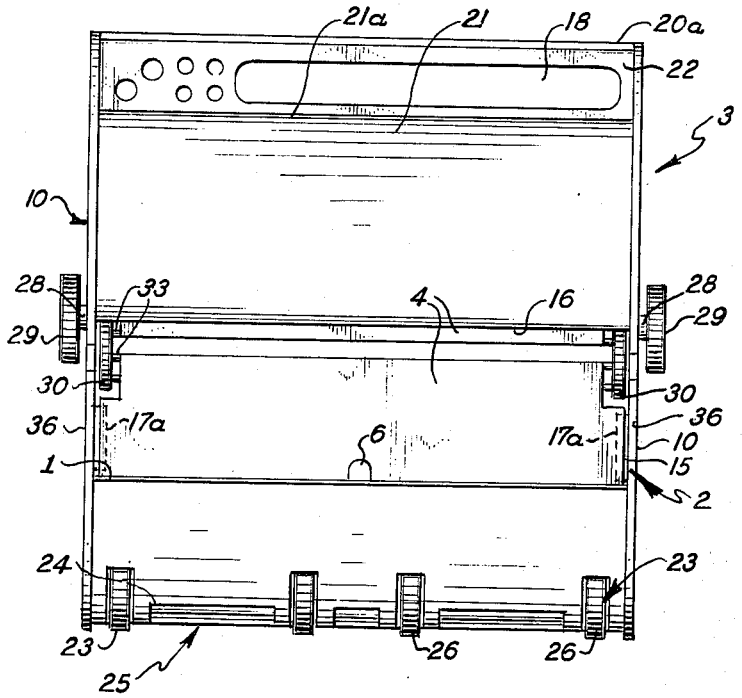
FIG. 4 is a top plan view of the apparatus of FIG. 1.

More specifically, referring to the drawings, the housing, generally designated 3, includes a base portion 20 and an upper portion 21. The base portion 20 has an arcuate section **20*a* that extends upwardly in the rear of the housing 3. The upper portion 21 includes a rear section 21*a* which extends downwardly to the base portion 20**.

The rear section **21*a* is laterally spaced in front of the bottom rear section 20*a* to form a storage area 18 for writing means. The storage area 18 includes a bottom section 19 which rises slantingly backwards. Consequently, stored pieces of note paper will project upwardly in the form of steps and therefore can be taken out more easily from the storage area 18. A punctured plate 22 is disposed at least partially over the chamber or storage area 18** so that the pencils may be kept separately. The holes in the punctured plate have a diameter which is slightly larger than the diameter of the customary pencils or recording styluses.

The base portion 20 is also turned upwardly in the form of the arc to form a forward projecting section or data section 25. Rollers 23 are mounted in the data section 25 and can be read through observation apertures 24. The data rollers 23 include annular flanges 26 disposed at the ends thereof. The annular flanges are effectively knurled and project through openings located in the front of the data section 25. The knurled annular flanges 26 are used to adjust the rollers in front of the observation apertures 24. The data rollers 23 are rotatably mounted on a support shaft 27 which extends between the inside of the lateral walls 10.

The lateral walls 10 have substantially identical shapes and extend from the front data section 25 upwardly and slantingly backwardly to form an obtuse angular section therein as shown. The upper portion 21 ends on top of the device with the leading edge 16 adjacent the upwardly extending edges 35 of the lateral walls 10. The lower base portion 21 extends upwardly to its upper edge 1 to a point between the upwardly and backwardly slanting edges 36 of the lateral walls 10.

An obtuse angle is formed between the upwardly extending edges 35 and the backwardly slanting edges 36. The distance between the upper edge 1 and the upwardly extending edge 35 corresponds to the distance from the leading edge 16 to the obtuse angle. The observation opening 2 is located between the walls 10 and between the leading edge 16 and the front edge 1 of the base portion 20. The leading edge 16 constitutes the upper edge of the observation opening 2. The front edge 1 constitutes the lower edge of the observation opening 2.

Shaft 28 is rotatably mounted between the lateral walls 10 at a location disposed in a direction slantingly backwards from the obtuse angle. Roller shaped bodies 29 are mounted on the outside of the lateral walls 10 and are used for turning the shaft 28. Inside roller bodies 30 are mounted on the inside of the lateral walls 10. The roller bodies 30 include opposing sides which face each other and include recesses 31 which are disposed annularly around the faces. Recesses 31 on one face are registered with recesses located in the other face to cooperate with cards 4 as indicated hereinbelow.

Information cards 4 include extensions 33 disposed laterally along the back 32. The extensions 33 are pivotally mounted within the recesses 31 which face each other across the distance between the lateral walls 10. A flexible reinforcing rib 34 is located along the reverse side or back 32 of the cards 4. Whenever a card 4 is pointing upwardly, the free edge 8 thereof points rearwardly. When the card 4 is tilted downwardly, the free edge 8 points forwardly with respect to the device.

The holding element 5 is in the form of a toggle lever and includes a supporting arm 6 and a heavier balancing arm 7 which hangs downwardly, as shown in FIg. 2. When the roller bodies 29 are turned in counter-clockwise direction as indicated by the arrow in FIG. 1, the cards 4 tilt downwardly about the pivot point 11. The cards 4 drop onto the supporting arm 6 which projects outwardly from the upper edge 1. When the card 4 has been turned past the supporting arm 6, the arm 6 pivots back into the path of the cards 4 by virtue of the counter-balancing weight of the heavier arm 7.

Referring to FIG. 2, the card **4*a* has been rotated downwardly and is supported by the reinforcing rib 34*a* within the observation opening 2 and magnets 17*a* that are disposed in or on the lateral walls 10. That is, the reinforcing rib 34*a* is located on the back 32 of the next preceding card as shown. Consequently, the card 4*a* remains in the observation opening 2 and its reverse side can be read or recordings be made thereon. Thus it is evident from the drawings that magnets 17*a* constitute holding means fixedly located along a side edge of the observation opening 2. The same pertains to the succeeding card 4 which stops in the upper portion of the observation opening 2 until the shaft 28 is turned further by means of the roller bodies 29.**

The shaft 28 may be turned in the counter-clockwise or opposite direction with respect to the arrow on body 29 as shown in FIG. 1. For example, to turn the card **4*a* in the reverse direction from that described hereinabove, the shaft 28 is rotated in the counter-clockwise direction. Card 4*a* is made of flexible material and the supporting arm 6 tends to hold it in the position as shown in FIG. 2. When enough pressure is placed on the rotating knob 29, the holding potential of the supporting arm 6 is overcome. Consequently, the card 4*a* will slide away from underneath and behind the supporting arm 6 and will resiliently jump back over the pivoting point 11. The card 4*a* will then rest against the magnets 17 and the front side of the card 4*a*** can be read or entries can be made on the exposed side.

Magnets or holding elements 17 are disposed in or on the inside surfaces of the lateral walls 10. Strips 15 disposed along the lateral edges 14 of the cards 4 cooperate with the magnets 17 and **17*a*. Strips 15 are composed of magnetizable material such at metallized foil that is glued onto the lateral edges 14 of the articulated or pivotally mounted cards 4. The magnets 17 act to hold the cards 4 within the upper portion 21** of the device thereby preventing a premature forward tilting or pivoting thereof.

Figure 5:
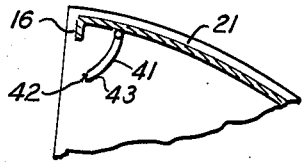
FIG. 5 is a fragmentary cross-sectional view of another embodiment of the invention.

In the embodiment of FIG. 5, the bent arm 43 is semi-circularly curved toward the front of the device and pivotally mounted at the upper edge 16 on the upper portion 21. As cards 4 are rotated backwardly, they swing upwardly and engage the forwardly extending free end 42 of the curved lever 43. Consequently, the arm or lever 42 that extends downwardly is pivoted backwardly. When cards 4 slides past the free end 42, the lever 43 swings back to its original position due to gravity.

While the device for recording on and storage of information cards has been shown and described in detail, it is obvious that this invention is not to be considered as being limited to the exact form disclosed, and that changes in detail and construction may be made therein within the scope of the invention, without departing from the spirit thereof.

Having thus set forth and disclosed the nature of this invention, what is claimed is:

1. A device for storing and recording on information cards composed of flexible material comprising:

a. means for pivotally mounting each card along one edge thereof within a housing having an observation opening for the information cards, b. holding means fixedly located along a side edge of the observation opening and a holding support element disposed along the lower edge of the observation opening, c. the said holding means including at least one magnet disposed on the side edge of and at a location below the lower edge of the observation opening, d. said cards including a strip of magnetizable material disposed along its outer free edge thereof to cooperate with the magnets for magnetically holding the card, e. said support holding element being pivotally mounted to swivel in one direction out of the path of the cards as the cards move downwardly past the lower edge of the observation opening, f. said support holding element being effective to hold the card back when the cards are moved in the upward direction, g. said cards being elastically held up to a predetermined tension sufficient for the cards to jump to an upstanding position once it is released by said holding support element.

2. A device as defined in claim 1 wherein said holding support element includes a toggle lever pivotally mounted below the lower edge of the observation opening, said toggle lever including an arm which projects into the path of the cards and a heavier arm which hangs downwardly in a direction angled away from the direction of said first arm.

3. A device as defined in claim 1 wherein the housing includes a storage means for containing paper and writing styluses.

4. A device as defined in claim 3 wherein said storage means includes a forwardly slanting portion to store pieces of note paper therein which paper will project upwardly in the form of steps.

5. A device as defined in claim 3 wherein the base portion of the housing includes a rear section which extends upwardly therefrom and the upper portion includes a rear section which extends downwardly therefrom, said upwardly extending rear portion being laterally spaced with respect to said downwardly extending rear section to form said storage means therebetween.

6. A device as defined in claim 3 wherein the storage means is disposed at the rear of the housing and includes a top cover having a plurality of openings for receiving writing styluses.

7. A device as defined in claim 1 wherein the housing includes a forward projecting section having observation apertures and data rollers rotatably mounted therein for viewing through the observation apertures.

8. A device as defined in claim 1 wherein a pivotally mounted lever is disposed at the upper edge of the observation opening to engage cards that resiliently jump from the lower portion of the observation opening to the upper portion of the observation opening.

9. A device as claimed in claim 1 wherein said magnetizable material is composed of metallized foil.

10. A device for storing and recording on information cards composed of flexible material comprising:

a. means for pivotally mounting each card along one edge thereof within a housing having an observation opening for the information cards, b. the observation opening being disposed between two upstanding lateral walls and including an upper observation portion and a lower observation portion, c. one side of said card being viewable in the upper portion and the other side of said card being viewable in the lower portion of the observation opening, d. holding means including holding magnets disposed along the sides of the observation opening and a holding support element disposed along the lower edge of the observation opening, e. said support holding element being pivotally mounted to swivel in one direction out of the path of the cards as the cards move downwardly past the lower edge of the observation opening, f. said support holding element being effective to hold the cards back when the cards are moved in the upward direction, g. said cards including strips of magnetizable material along both outer edges thereof to cooperate with said magnets for holding each card in place within the observation opening, h. said cards being elastically held up to a predetermined tension sufficient for the cards to jump to an upstanding position once it is released by said holding support element.

11. A device as defined in claim 10 wherein the holding magnets are disposed below the upper edge of the observation opening and are effective to retard the forward tilting pivoting movement of the storage information cards forward, and said upper holding magnets being further effective to catch the storage cards when jumping upwardly after having been flexibly held in place by the holding element disposed along the lower edge of the observation opening.

* * * * *